US010240382B2

(12) United States Patent
Oster et al.

(10) Patent No.: US 10,240,382 B2
(45) Date of Patent: Mar. 26, 2019

(54) SCISSOR DRIVE

(71) Applicant: Stabilus GmbH, Koblenz (DE)

(72) Inventors: Peter Oster, Koblenz (DE); Mathias Wieland, Koblenz (DE)

(73) Assignee: Stabilus GmbH, Koblenz (DE)

( * ) Notice: Subject to any disclaimer, the term of this patent is extended or adjusted under 35 U.S.C. 154(b) by 26 days.

(21) Appl. No.: 15/396,954

(22) Filed: Jan. 3, 2017

(65) Prior Publication Data

US 2017/0191300 A1 Jul. 6, 2017

(30) Foreign Application Priority Data

Jan. 5, 2016 (DE) ..... 10 2016 200 019

(51) Int. Cl.
*E05F 15/63* (2015.01)
*E05F 15/614* (2015.01)

(52) U.S. Cl.
CPC ..... *E05F 15/63* (2015.01); *E05F 15/614* (2015.01); *E05Y 2201/216* (2013.01); *E05Y 2201/236* (2013.01); *E05Y 2201/434* (2013.01); *E05Y 2201/694* (2013.01); *E05Y 2201/696* (2013.01); *E05Y 2201/702* (2013.01); *E05Y 2201/704* (2013.01); *E05Y 2201/72* (2013.01); *E05Y 2600/458* (2013.01); *E05Y 2800/114* (2013.01);
(Continued)

(58) Field of Classification Search
CPC ..... E05F 15/63; E05F 15/614; E05F 15/60; E05F 15/00; E05F 15/603; E05Y 2900/546; E05Y 2900/531; E05Y 2900/40; E05Y 2900/548; E05Y 2201/216; E05Y 2201/246; E05Y 2201/462; E05Y 2201/434; E05Y 2201/72
See application file for complete search history.

(56) References Cited

U.S. PATENT DOCUMENTS 5,221,239 A * 6/1993 Catlett ..... E05F 15/614 475/342
5,535,551 A * 7/1996 Falk ..... E05F 11/24 49/140
(Continued)

FOREIGN PATENT DOCUMENTS

CN 1408044 4/2003
DE 2923421 12/1980
(Continued)

OTHER PUBLICATIONS

English translation of DE2923421.*
(Continued)

*Primary Examiner* — Justin B Rephann
(74) *Attorney, Agent, or Firm* — Rankin, Hill & Clark LLP

(57) ABSTRACT

A scissor drive includes two legs which can be pivoted relative to one another about a pivot axis, each having a longitudinal axis and designed to be connected to an external component, and a motor/gear assembly that drives the relative pivoting movement of the two legs. The first leg includes a housing that is hollow at least in portions, a cavity defined in the hollow housing extending at least in portions along the longitudinal axis of the first leg, and the motor/gear assembly being received in the housing of the first leg at least in portions in the portion of the cavity that extends along the longitudinal axis of the first leg.

11 Claims, 2 Drawing Sheets

(52) U.S. Cl.
CPC ... *E05Y 2900/546* (2013.01); *E05Y 2900/548* (2013.01)

(56) References Cited

U.S. PATENT DOCUMENTS 5,772,274 A * 6/1998 Tokarz ..... B60J 7/1269 296/107.09
5,823,905 A * 10/1998 Torii ..... G01D 5/25 475/149
5,920,158 A * 7/1999 Miller ..... B60N 2/0248 15/250.001
6,003,268 A * 12/1999 Oruganty ..... E05F 15/689 49/349
6,162,142 A * 12/2000 Hori ..... B60J 7/0573 296/223
6,262,548 B1 * 7/2001 Scholten ..... E05F 15/614 16/62
6,336,294 B1 * 1/2002 Kowalczyk ..... E05D 15/54 49/339
6,481,160 B1 * 11/2002 Kowalczyk ..... E05F 3/224 49/333
6,530,175 B2 * 3/2003 Sato ..... E05F 11/445 475/170
6,553,717 B2 * 4/2003 St. John ..... E05F 15/603 192/69.8
6,754,990 B2 * 6/2004 Pedemonte ..... E05F 15/603 49/336
7,832,057 B2 * 11/2010 Hoffman ..... E05D 3/06 16/287
8,585,124 B2 * 11/2013 Oberle ..... F16H 37/041 296/106
9,869,117 B2 * 1/2018 Houser ..... E05F 15/611
2004/0097318 A1 * 5/2004 Greuel ..... F16D 65/06 475/149
2005/0127711 A1 * 6/2005 Rigorth ..... E05F 15/63 296/146.4
2007/0051046 A1 * 3/2007 Yoshida ..... E05F 15/63 49/345
2009/0265992 A1 * 10/2009 Hass ..... E05F 15/63 49/340
2010/0156141 A1 6/2010 Mueller
2011/0094160 A1 * 4/2011 Houser ..... E05F 15/63 49/31
2012/0029701 A1 * 2/2012 Houser ..... E05F 15/70 700/275
2013/0199321 A1 * 8/2013 Oberle ..... F16D 7/021 74/89.14
2014/0325911 A1 * 11/2014 Hass ..... E05F 15/70 49/31
2014/0373454 A1 * 12/2014 Sasaki ..... E05F 15/63 49/350

FOREIGN PATENT DOCUMENTS

| | | |
|---|---|---|
| DE | 102004058114 | 6/2006 |
| DE | 102008063571 | 7/2010 |
| DE | 102011114925 | 4/2013 |
| DE | 102014202765 | 8/2015 |
| EP | 0764755 | 3/1997 |
| FR | 2689171 | 10/1993 |
| WO | 01/42608 | 6/2001 |

OTHER PUBLICATIONS

Extended European Search Report of DE Application No. 17150286.7 dated May 16, 2017, 7 pages.
Office Action of CN201710004482.1 dated Dec. 18, 2017, 7 pages.
English translation Office Action of CN201710004482.1 dated Dec. 18, 2017, 7 pages.
Search Report of DE Application No. 10 2016 200 019.5 dated Jul. 14, 2016, 8 pages.

* cited by examiner

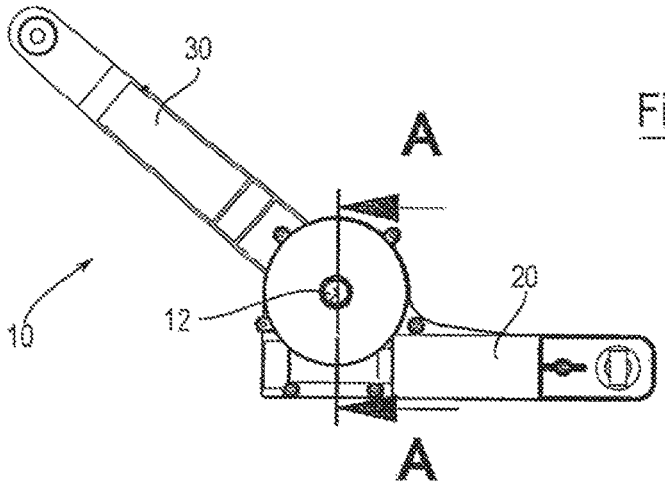
Fig.2
Fig.3
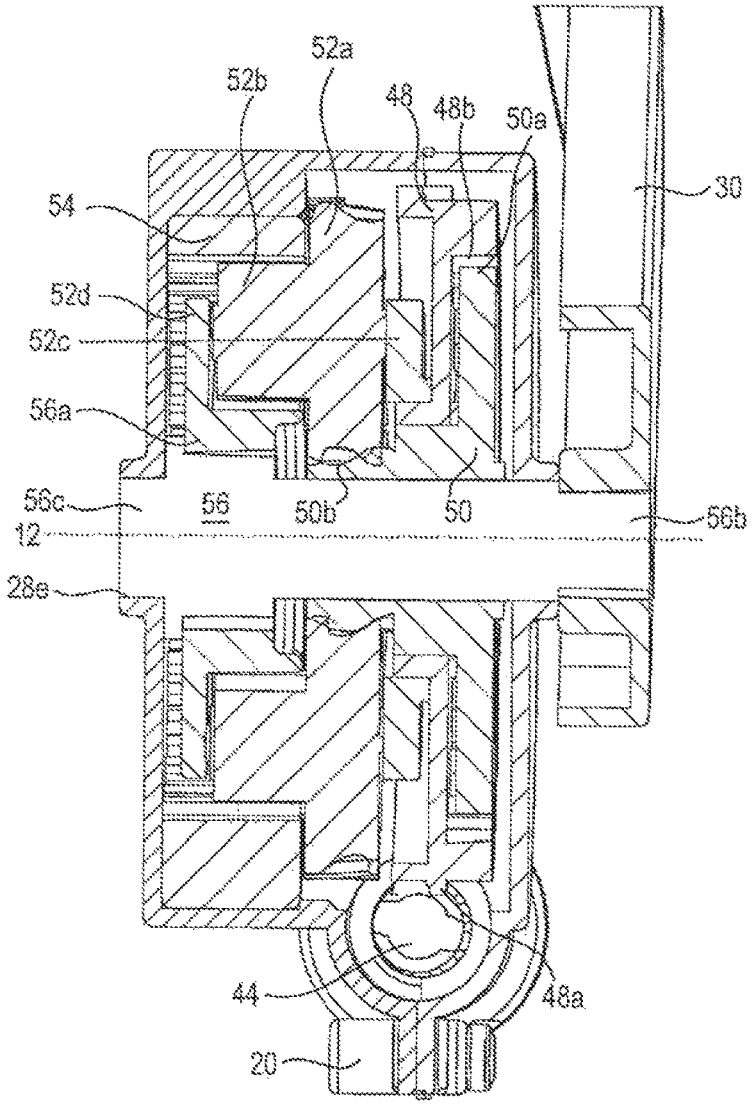

SCISSOR DRIVE

BACKGROUND

The present invention relates to a scissor drive, comprising two legs which can be pivoted relative to one another about a pivot axis, each having a longitudinal axis and designed to be connected to an external component, and a motor/gear assembly that drives the relative pivoting movement of the two legs.

Scissor drives of this kind are known from uses in which the angle between two components that are pivotally interconnected is intended to be adjustable. For example, scissor drives are used to automatically tilt windows in buildings or to open and close tailgates in motor vehicles. In known scissor drives, however, the actual means for driving the pivotal movement, i.e. a motor, for example an electric motor, is designed to be separate from the two legs of the scissor drive, and is located, for example, on the hub that corresponds to the pivot axis of the scissor drive, in the case of a rotary motor of which the rotational axis is perpendicular to the plane formed by the two legs.

Scissor drives of this kind therefore require more space, particularly outside the pivot plane of the two legs, because, as already discussed, the motor of the drive extends out of this plane.

The object of the present invention is therefore to provide an improved scissor drive which requires less space than scissor drives known from the prior art and can be produced so as to be lightweight and cost-effective as a result of its increased integration.

BRIEF DESCRIPTION

This object is solved according to the invention by the first leg comprising a housing which is hollow at least in portions, a cavity defined in the hollow housing extending at least in portions along the longitudinal axis of the first leg, and the motor/gear assembly being received in the housing of the first leg at least in portions in the portion of the cavity that extends along the longitudinal axis of the first leg. This structural feature makes it possible to minimise the installation space required by the scissor drive, in particular outside the pivot axis of the two legs. Furthermore, a separately designed motor housing can be dispensed with owing to the motor/gear assembly being integrated in the housing of the first leg, and this reduces the weight of the scissor drive by comparison with known scissor drives. Furthermore, the motor/gear assembly is better protected against damage and/or soiling when it is designed according to the invention than when it is designed to be separate from the two legs, for example on a hub of the scissor drive.

In an embodiment of the scissor drive according to the invention, the motor/gear assembly can comprise a rotary motor, the rotational axis of which extends substantially in parallel with the longitudinal axis of the first leg. Such a design makes it possible to utilise the available installation space in an optimal manner, since the longitudinal extension of the first leg is used to receive the corresponding motor, and rotary motors of this kind are also particularly cost-effective and reliable. As an alternative, however, depending on the intended use, it is also possible to use other motors, such as linear motors. Furthermore, the term "motor/gear assembly" is not to be understood to mean that a gear is necessarily required, but rather it is possible to dispense with the gear entirely if an appropriate motor having sufficient torque is selected.

In a development, the motor/gear assembly can comprise a reduction gear, which is preferably provided with a reduction ratio of between 1:20 and 1:100, more preferably approximately 1:50. The use of a reduction gear of this kind makes it possible to use commercially available rotary electric motors which generally have a relatively high speed, but a comparatively low torque. Using the reduction gear, the relative pivoting speed of the two legs can be reduced, while at the same time the torque applied is increased, in order to be able to apply a sufficient force for pivoting the external components connected to the two legs.

Furthermore, the scissor drive according to the invention can be designed such that it comprises a worm gear which is designed to convert a rotational movement of the rotary motor into a relative pivoting movement between the two legs. Worm gears of this kind are known per se and offer a durable and reliable option for converting a rotational movement about a first axis into a rotational movement about a second axis which is perpendicular to the first axis.

In a development, the scissor drive according to the invention may also comprise a planetary gear train which gears down the relative pivoting movement of the two legs, preferably at a reduction ratio of between 1:3 and 1:10, more preferably approximately 1:7.5. In this case, the planetary gear train can be provided in addition to or as an alternative to the reduction gear of the motor/gear assembly that has already been mentioned. In particular, when both gears are used, there may be especially high reduction ratios of 1:300 or more.

In order to achieve the desired reduction in the planetary gear train, said planetary gear train can comprise, for example, two sets of concentrically arranged planet gears which are interconnected in pairs for conjoint rotation. Stepped planet gears of this kind, which are concentrically supported by the planet carrier of the planetary gear train, are a way of being able to produce the desired reduction ratio in a durable and compact manner.

In a preferred development, the scissor drive according to the invention can further comprise an overload protection means, which can prevent the mechanical parts and the motor of the scissor drive from becoming damaged during improper use, e.g. by the influence of a high external torque.

In this regard, the overload protection means can be formed, for example, by a gearwheel and a hollow gearwheel which meshes with said gearwheel, the teeth of the gearwheel being arranged such that, when a predetermined maximum torque is exceeded, said teeth can slip over the teeth of the hollow gearwheel, such that a reduced torque is transmitted between the hollow gearwheel and the gearwheel. For this purpose, recesses can be provided in the gearwheel for example which make it possible for the regions on the circumference of the gearwheel that are provided with teeth to pivot out of engagement with the teeth of the hollow gearwheel when overloaded. Overload protection devices of this kind can be produced in a simple and cost-effective manner and are easy to integrate in the scissor drive according to the invention, the space required by the scissor drive increasing only slightly, if at all.

In another preferred development, the worm gear and/or the planetary gear train and/or the overload protection means can also be received at least in portions in the housing of the first leg. This structural feature also makes it possible to reduce the installation space required by the scissor drive in each case, and the resulting encapsulation of the particular mechanical components also ensures that these components do not become damaged or soiled.

In a second aspect, the invention relates to a vehicle, for example a limousine, which comprises at least one scissor drive according to the invention, one of the two legs being rigidly connected to the body of the vehicle and the other of the two legs being connected to an element which is pivotally attached to the body of the vehicle. In this case, it is up to a person skilled in the art to decide whether it is the first leg, in which the motor/gear assembly is received, or the second leg that is to be associated with the body. The element which is pivotally attached to the body can be in particular a tailgate, a boot lid, a door or a similar element of the vehicle.

BRIEF DESCRIPTION OF THE DRAWINGS

Additional features and advantages of the present invention will be described in detail in the following by way of example with reference to the accompanying figures, in which:

FIG. 2 is a side view of the scissor drive from FIG. 1 in the assembled state; and FIG. 3 is a section through the embodiment from FIGS. 1 and 2 along the arrows A in FIG. 2.

DETAILED DESCRIPTION

Figure 1:
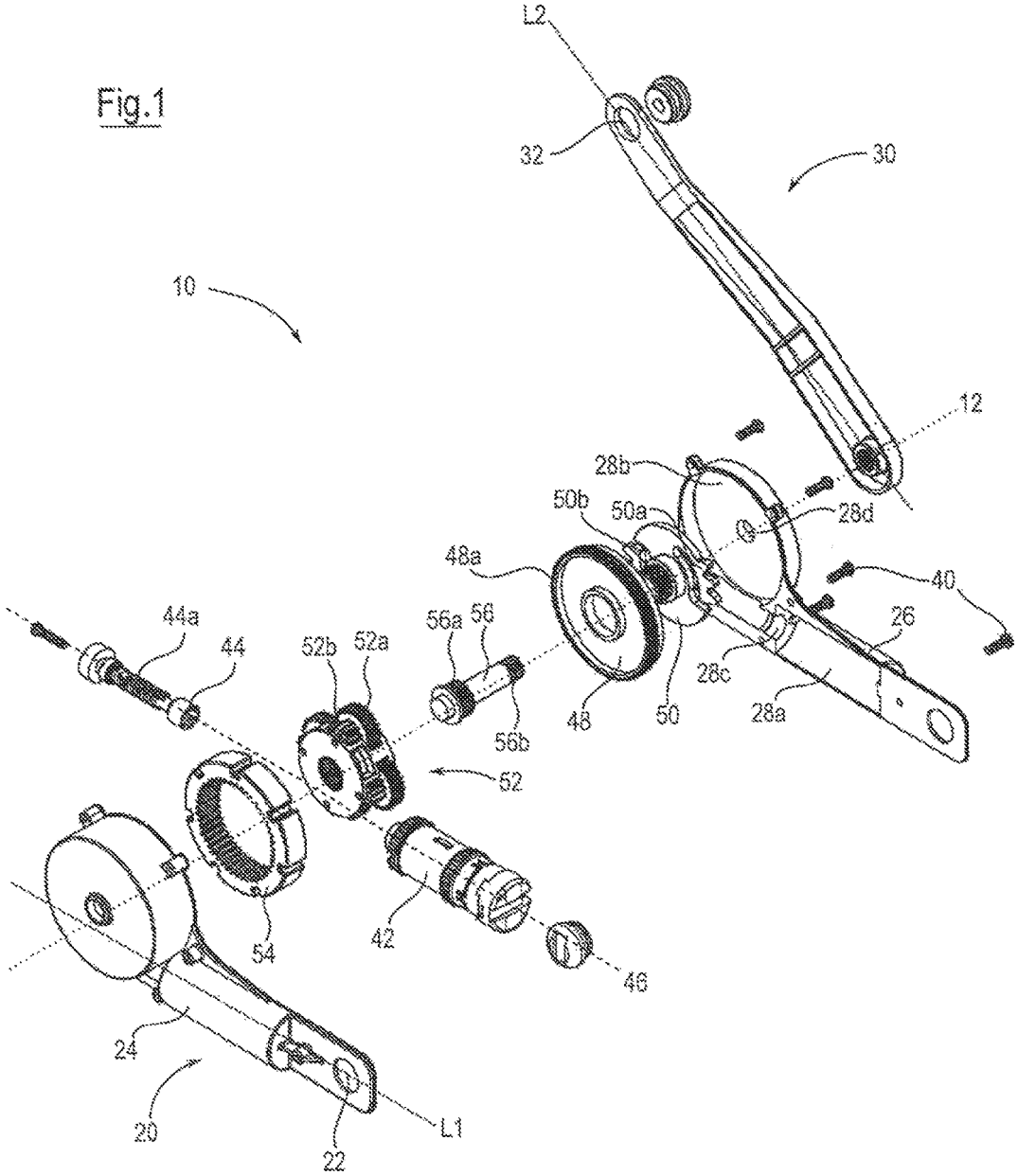
FIG. 1 is an exploded view of an embodiment of a scissor drive according to the invention.

FIG. 1 is an exploded view of an embodiment of a scissor drive according to the invention, which is provided in a very general manner with reference numeral 10. The scissor drive comprises a first leg 20 and a second leg 30 which can be pivoted away from one another about a pivot axis 12 indicated by a dashed line and which each comprise a longitudinal axis L1 and L2, respectively, which is also indicated by a dashed line in FIG. 1. The two legs 20 and 30 each comprise, on the side thereof that is opposite the pivot axis 12, through-holes 22 and 32, by means of which said legs can be connected to external components using bolts or the like for example. The first leg 20 consists of a first housing part 24 and a second housing part 26 which are interconnected by means of a plurality of screws 40 when the scissor drive is assembled. Alternatively or additionally, however, other connection techniques known to a person skilled in the art can be used for the two housing parts, for example adhesion, welding, snap-fitting, etc.

The two housing parts 24 and 26 are hollowed in portions and, when assembled, form a housing in which there is defined a cylindrical first cavity 28*a*, which extends along the longitudinal axis L1 of the first leg 20, and a second cavity 28*b* which is connected to said first cavity and extends in a circle around the pivot axis 12. The connection between the first cavity 28*a* and the second cavity 28*b* is formed by a cylindrical portion 28*c*. When the scissor drive 10 is assembled, a motor/gear assembly 42 is mounted in the first cavity 28*a*, which motor/gear assembly comprises a rotary electric motor and a reduction gear on the output thereof.

When the scissor drive 10 is assembled, an output shaft 44 is fastened by a flange to the output of the reduction gear of the motor/gear assembly 42, which output shaft extends through the cylindrical portion 28*c* from the first cavity 28*a* into the second cavity 28. When the scissor drive 10 is in operation, the output shaft 44 rotates about an axis 46, which is also indicated by a dashed line, in a manner corresponding to the speed of the motor and the reduction ratio of the reduction gear. On the outer periphery of the output shaft 44, there is a set of angular teeth 44*a* which enables the output shaft to be used as a screw shaft in a worm gear. A worm gearwheel 48 meshes with this set of teeth 44*a*, has on its outer circumference a corresponding gear rim 48*a* and converts the movement of the output shaft 44 about the rotational axis 46 into a rotation about the pivot axis 12.

On the outer circumference of the worm gearwheel 48, there is also an inward-facing gear rim which is, however, hidden in the illustration in FIG. 1 but is provided with reference numeral 48*b* in FIG. 3. In turn, the toothed portions 50*a* of an overload protection gearwheel 50 mesh with this inward-facing gear rim 48*b*. Said toothed portions 50*a* are formed such that they comprise a projection which is part of the outer circumference of the overload protection gearwheel 50 and are undercut such that the teeth located on the relevant portion 50*a* can pivot radially inwards when there is an external torque which acts on the overload protection gearwheel 50 and exceeds a maximum torque, in order to thus pivot out of engagement with the inward-facing gear rim 48*b* of the worm gearwheel 48. In this way, the gearwheels 48 and 50 work together to provide overload protection, for example when an external torque acts on the second leg 30 in an inappropriate manner.

The hub of the overload protection gearwheel 50 extends through the hub of the worm gear 48, a toothed portion 50*b* being provided in this extension region. In turn, first planet gears 52*a* of a planetary gear train 52 mesh with this toothed region 50*b*. In this case, the planetary gear train 52 is formed as a stepped planetary gear train, the first planet gears 52*a* being rigidly connected in a coaxial manner to second planet gears 52*b*, the second planet gears 52*b* having a smaller diameter than the first planet gears 52*a* and thus a smaller number of teeth.

The second planet gears 52*b* run on the inner toothing of a hollow gearwheel 54 which is rigidly mounted in the cavity 28*b* and thus connected for conjoint rotation with the first leg 20. A gear rim 56*a* of an axle 56 acts as the sun gear in this planetary gear train 52 and also engages with the second planet gears 52*b*. As a result of the selected proportions of the toothing 56*a*, the hollow gearwheel 54 and the diameters of the planet gears 52*a*, 52*b*, respectively, the rotational movement is reduced further. When the scissor drive 10 is assembled, the axle 56 extends from the engagement region thereof with the toothing 56*a* between the first planet gears 52, through the hub of the worm gearwheel 48 and of the overload gearwheel 50 and exits the second cavity 28*b* of the first leg 20 via an opening 28*d* towards the outside. At this point, the second leg 30 can be attached to the second end 56*b* of the axle 56.

In the embodiment shown, the rotational moment of the motor gear assembly 42 is accordingly first reversed by the worm gear formed of the elements 44*a* and 48*a*, subsequently forwarded by the overload protection means formed of elements 48 and 50, geared down once again by the planetary gear train 52 and then transmitted to the second leg 30.

FIG. 2 is a side view of the scissor drive 10 from FIG. 1 in the assembled state. This figure shows a section plane which extends through the pivot axis 12 of the two legs 20 and 30, the view from FIG. 3 being understood to be in the direction of arrows A.

This view in FIG. 3 shows the elements arranged around the pivot axis 12 of the scissor drive 10 in the assembled state. The axle 56 is rigidly connected to the second leg 30 by its output end 56*b*. At its other end 56*c*, the axle 56 is rotatably received in a recess 28*e* in the first housing part 24 of the first leg 20. The gear rim 56*a* is also located on the axle 56, which gear rim meshes with the second planet gears 52*b*.

These second planet gears 52*b* also mesh at the other end with the hollow gearwheel 54 and are rotatably located on a planetary axle 52*c*, which is indicated by a dashed line and is connected to the planet carrier 52*d* of the planetary gear train. The planet gears 52*a* are also supported by the planetary axle 52*c* in a manner in which they are concentrically connected to the second gears 52*b* for conjoint rotation. The radially inner sides of these planet gears mesh with the set of teeth 50*b* of the overload protection gearwheel 50 which comprises the engagement portions 50*a* on the other end thereof. In the above-described manner, said engagement portions are in engagement with the inner toothing 48*b* of the worm gearwheel 48, whereas the outer toothing 48*a* of the worm gearwheel 48 meshes with the screw shaft 44 which is driven by the motor/gear assembly 42 in the above-described manner.

The invention claimed is:

1. Scissor drive, comprising:

two legs which can be pivoted relative to one another about a pivot axis, each having a longitudinal axis extending between a free end and a pivot end, the pivot end being distal to the free end, each of the two legs being designed to be connected to an external component at the free end and to each other at the pivot end, a rotary motor that drives the relative pivoting movement of the two legs, the rotary motor having a rotational axis which extends substantially in parallel with the longitudinal axis of a first leg of the two legs, a planetary gear train located at the pivot end of each of the two legs, and a worm gear operatively connecting the rotary motor to the planetary gear train, and which is designed to convert a rotational movement of the rotary motor into a relative pivoting movement between the two legs;

wherein:

the first leg comprises a hollow housing, a cavity is defined in the hollow housing, the cavity extending along the longitudinal axis of the first leg, and the rotary motor is received in the cavity.

2. Scissor drive according to claim 1, further comprising a reduction gear operatively connecting the rotary motor and the worm gear and having a reduction ratio of between 1:20 and 1:100.

3. Scissor drive according to claim 1, wherein the planetary gear train has a reduction ratio of between 1:3 and 1:10.

4. Scissor drive according to claim 3, wherein the planetary gear train comprises two sets of concentrically arranged planet gears which are interconnected for conjoint rotation in pairs.

5. Scissor drive according to claim 1, further comprising an overload protection means.

6. Scissor drive according to claim 5, wherein:

the overload protection means is formed by a gearwheel with radially outward extending teeth and a hollow gearwheel with radially inward extending teeth, the gearwheel is arranged inside the hollow gearwheel such that the radially outward extending teeth mesh with the radially inward extending teeth, and when a predetermined maximum torque is exceeded, the radially outward extending teeth of the gearwheel are pushed radially inward and slip past the radially outward extending teeth of the hollow gearwheel such that a reduced torque is transmitted between the hollow gearwheel and the gearwheel.

7. Scissor drive according to claim 5, wherein the worm gear and/or the planetary gear train and/or the overload protection means are also received at least in portions in the housing of the first leg.

8. Scissor drive according to claim 1, further comprising an overload protection gearwheel located at the pivot end of the each of the two legs and operatively connecting the worm gear to the planetary gear train.

9. Scissor drive according to claim 8, wherein the planetary gear train comprises a planet gear, the worm gear comprises an inward-facing gear rim, and the overload protection gearwheel comprises:

first teeth that mesh with the inward-facing gear rim of the worm gear; and second teeth that mesh with the planet gear of the planetary gear train.

10. A vehicle comprising at least one scissor drive according to claim 1, wherein one of the two legs is rigidly connected to a body of the vehicle and the other of the two legs is connected to an element which is pivotally attached to the body of the vehicle.

11. A vehicle according to claim 10, wherein the element which is pivotally attached to the body is a tailgate, a boot lid, or a door.

* * * * *